US005463846A

United States Patent [19]

Gambetti

[11] Patent Number: 5,463,846

[45] Date of Patent: Nov. 7, 1995

[54] METHOD OF AND APPARATUS FOR WRAPPING AN ARTICLE

[75] Inventor: Mario Gambetti, Crevalcore, Italy

[73] Assignee: Baumer S.R.L., Castelfranco Emilia, Italy

[21] Appl. No.: 261,987

[22] Filed: Jun. 17, 1994

[30] Foreign Application Priority Data

Jun. 18, 1993 [IT] Italy ..... BO93A0279

[51] Int. Cl.[6] ..... B65B 11/00; B65B 49/00; B65B 13/04

[52] U.S. Cl. ..... 53/465; 53/589; 53/210

[58] Field of Search ..... 53/588, 589, 465, 53/209, 210, 389.1, 389.5, 48.7, 389.3, 399

[56] References Cited

U.S. PATENT DOCUMENTS

| | | | |
|---|---|---|---|
| 3,540,187 | 11/1970 | Monaghan | 53/209 |
| 3,791,100 | 2/1974 | Monaghan | 53/389 |
| 4,083,163 | 4/1978 | Ganz | 53/48.7 |
| 4,663,914 | 5/1987 | Ganz . | |
| 5,203,144 | 4/1993 | Gambetti | 53/465 |
| 5,203,146 | 4/1993 | Gambetti | 53/588 |

FOREIGN PATENT DOCUMENTS

| | | | |
|---|---|---|---|
| 0004744 | 10/1979 | European Pat. Off. | 53/48.7 |
| 0049377 | 4/1982 | European Pat. Off. . | |
| 0229452 | 7/1987 | European Pat. Off. . | |
| 1918037 | 10/1969 | Germany . | |

*Primary Examiner*—John Sipos
*Assistant Examiner*—Rodney Butler
*Attorney, Agent, or Firm*—Herbert Dubno

[57] ABSTRACT

A method for setting pieces of wrapping material, in a machine for wrapping articles with pieces of wrapping material, during the wrapping phase of the article, includes transporting each single wrapping material piece by means of a plurality of bar means which are disposed set apart with reference to the transport direction, and cooperating with each other. An apparatus for carrying out this method includes a plurality of closed loop transport means, at least one wrapping bar associated to each one of the above mentioned transport means, driving means designed to drive, in proper connection, the transport means.

7 Claims, 6 Drawing Sheets

METHOD OF AND APPARATUS FOR WRAPPING AN ARTICLE

FIELD OF THE INVENTION

The present invention relates to a method of and an apparatus for transporting a piece of wrapping material during the article wrapping phase in a machine for wrapping articles with pieces of wrapping material, particularly heat-shrinkable material.

BACKGROUND OF THE INVENTION

A wrapping machine as described in U.S. Pat. Nos. 3,791,100, 5,203,144 and 5,203,146, generally comprises:

- a first conveyor, supporting the articles to be wrapped and feeding them one by one to a second conveyor;
- a second wrapping phase conveyor having an inlet end, an outlet end, and an upper surface between the inlet and outlet ends, this upper surface supporting and conveying articles while they are wrapped in succession;
- means for feeding single pieces of wrapping material, in succession, to the wrapping phase conveyor, placing the leading extremity of each piece on the upper surface of the wrapping phase conveyor, at the inlet end thereof;
- wrapping means comprising an endless conveyor carrying at least one wrapping bar along a path surrounding the above mentioned wrapping phase conveyor, and carrying the heat-shrinkable set the above mentioned heat-shrinkable wrapping pieces over and in front of each article then placing the rear extremity of the piece in a region between the second conveyor and the upstream end of a third receiving conveyor;
- a third receiving conveyor, for receiving and supporting the partially wrapped articles, aimed placing the rear extremity of the wrapping material piece under the leading extremity of the same wrapping material piece; and
- synchronising means, designed to set in proper timed relation the first conveyor, the first conveyor, the motion of the above mentioned second conveyor, the means for feeding the wrapping material, the endless transport means and the related wrapping bar, and the motion of the third receiving conveyor.

These machines, made as explained hitherto, are affected by several drawbacks as far as the transport of the wrapping material piece by the wrapping bar endless transport means is concerned.

BRIEF DESCRIPTION OF THE DRAWINGS

The above and other objects, features, and advantages will become more readily apparent from the following description, reference being made to the accompanying drawing in which.

DESCRIPTION OF PRIOR ART

With reference to FIGS. 1, 2, 3, 3*a* and 3*b*, which show a sequence of operations in the main wrapping stages, in which an article is wrapped while being made to advance, in accordance with the known method as described above, the article is fed by the feeding conveyor to the wrapping conveyor 2 along which the wrapping of the articles is performed, the wrapped article then being carried off by the receiving conveyor.

An endless transport means 4 carries, for instance, two wrapping bars 5*a* and 5*b*.

The wrapping material feeding means 6 supplies the wrapping material pieces 7*a* and 7*b*. The articles to be wrap packaged are shown as 8*a* and 8*b*.

Figure 1:
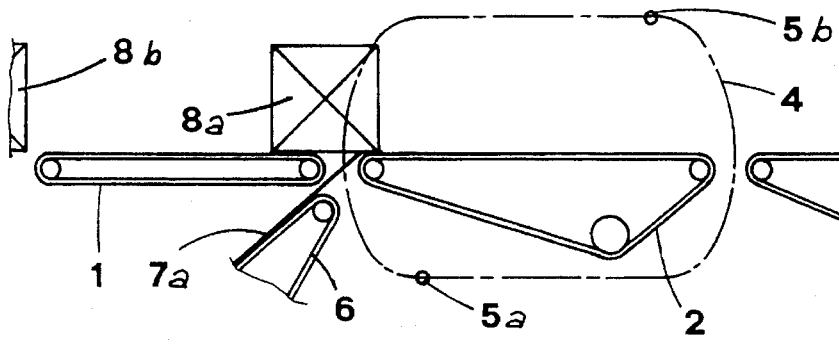
FIG. 1 PRIOR ART
FIG. 1, 2, 3, 3*a* and 3*b* are sequence diagrams illustrating one prior art wrapping system.

As seen from FIG. 1, an article 8*a* to be wrapped, is transferred from the conveyor 1 to the conveyor 2. In the meanwhile the wrapping material piece 7*a* is fed by the conveyor 6, which places the leading edge of the wrapping material between the bottom of the article 8 and the conveyor 2.

Figure 2:
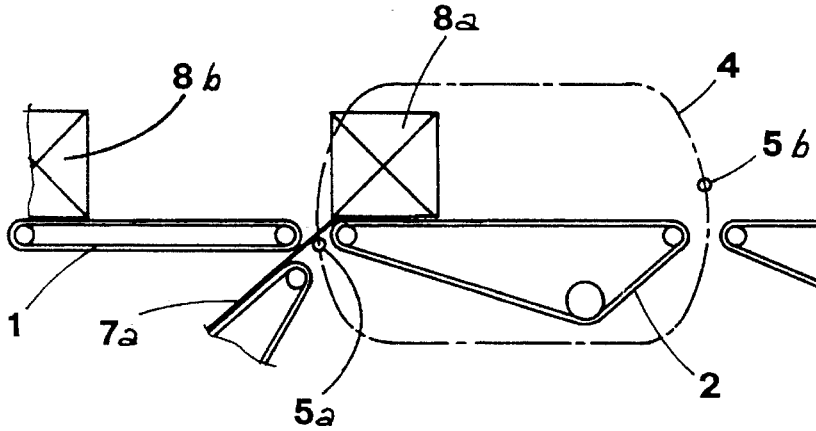
FIG. 2 PRIOR ART

In FIG. 2, the whole article is placed on the conveyor 2 with the leading part of the wrapping material situated between the bottom of the article 8*a* and the transport surface of the conveyor 2, while the wrapping bar 5*a*, suitably synchronised, intercepts the wrapping material piece 7*a* in its intermediate region.

Figure 3:
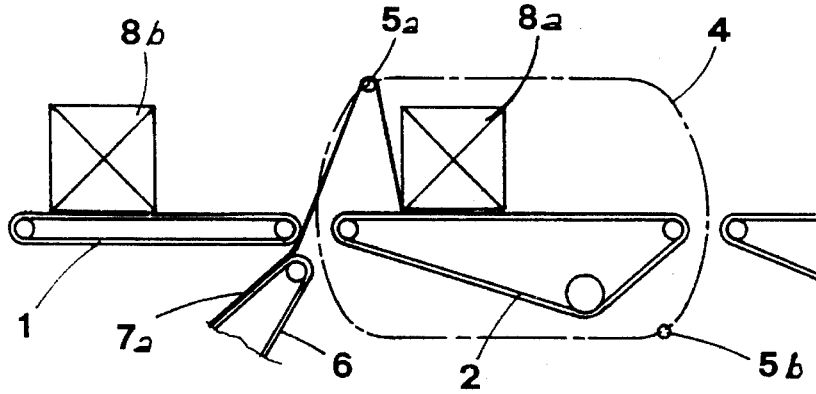
FIG. 3 PRIOR ART

Referring to FIG. 3, the wrapping bar 5*a* has begun the transport of wrapping material piece 7*a* around the article.

Figure 3A:
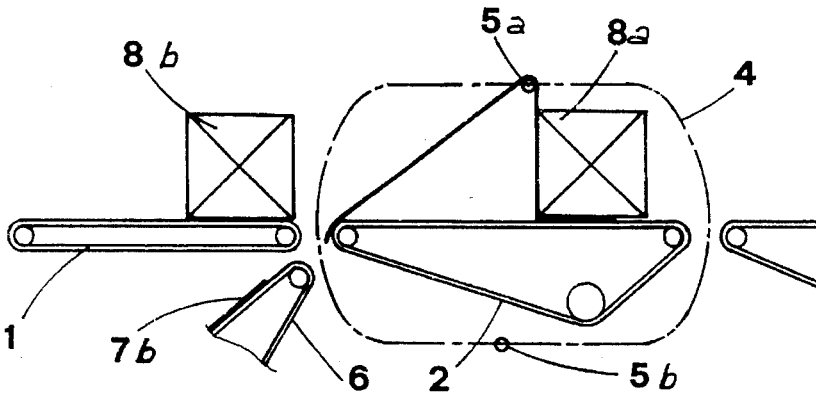
FIG. 3a PRIOR ART

As shown in FIG. 3*a*, the article 8*a* is moved forward and the transfer of the subsequent article 8*b* from the conveyor 1 to the conveyor 2 can take place only when the rear extremity of the wrapping material piece 7*a* is beyond the inlet end of the conveyor 2, so that the leading end of the said subsequent article 8*b* does not push the rear extremity of the wrapping material piece 7*a* against the conveyor 2, thus preventing movement of the wrapping material piece 7*a* pulled by the bar 5*a*.

For this reason, the distance between the preceding package 8*a* and the subsequent package 8*b* must be in a given relation with the length of the wrapping material piece.

This distance determines the feeding rate of the articles 8*a*, 8*b*, etc., defining the production capacity of the wrapping machine.

Figure 3B:
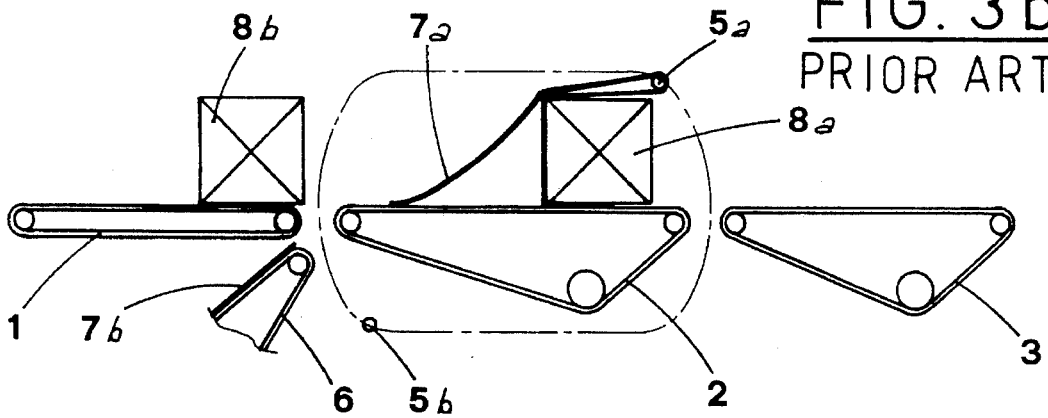
FIG. 3b PRIOR ART

Referring now to FIG. 3*b*, it is noted that, during application of the wrapping material piece 7*a* by the bar 5*a* around the article, the part of the wrapping material 7*a* at the back of the bar 5*a* touches the part of the wrapping material 7*a* ahead of the bar 5*a*, thus provoking adherence of the two contacting surfaces.

This adherence, in its turn, brings about undesired creeping effects resulting principally from electrostatic charge on the wrapping material.

In particular environmental situations, such effects could not allow for the correct spreading of the wrapping material piece thus making it impossible to use the machine with particular types of wrapping material or with particular lengths of the wrapping material pieces.

Figure 4:
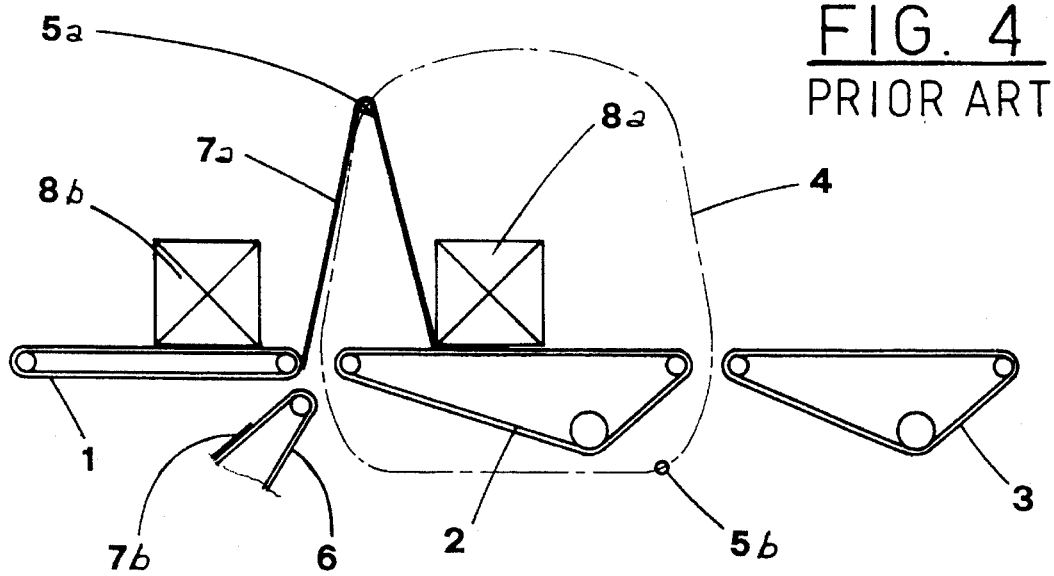
FIG. 4 PRIOR ART
FIGS. 4 and 4a are sequence diagrams illustrating another prior art system.
Figure 4A:
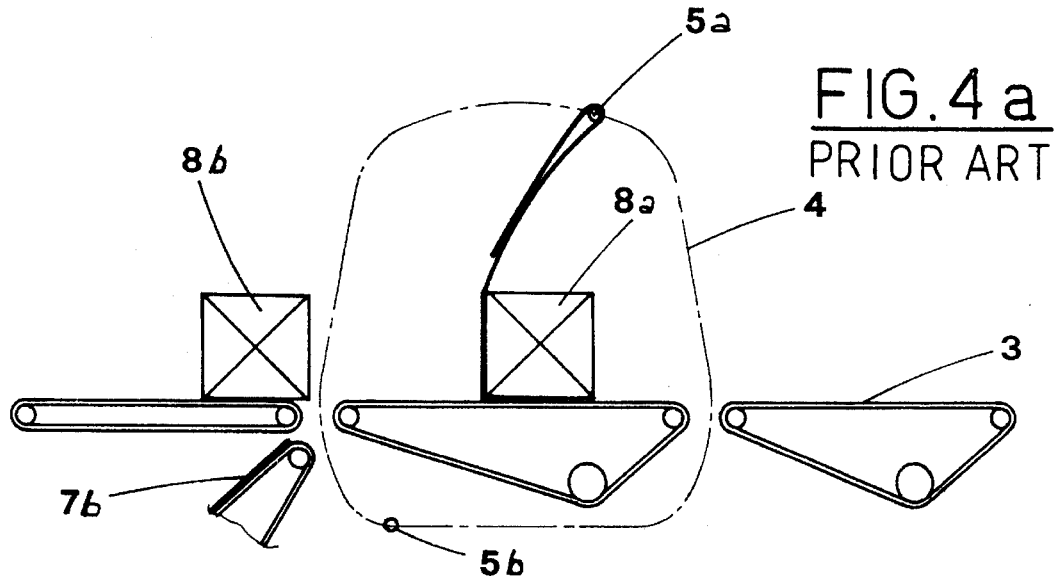
FIG. 4a PRIOR ART

In the system illustrated in FIGS. 4 and 4*a*, provides for early withdrawal of the rear part of wrapping material piece 7*a*, so that the step between the articles may be reduced in order to increase the productive capacity of the wrapping machine.

The substantial difference between the two embodiments lies in the fact that the close loop path of the endless transport means has the upper path considerably higher than the top of the article to be wrapped.

This arrangement has many drawbacks, the first of which results from the fact that during the phases of wrapping the article, the part of wrapping material piece comprised between the wrapping bar 5*a* and the top of the article, due to its forward advancement, fills with air and swells, causing a longitudinal tension that sometimes can withdraw the lead extremity of the wrapping material piece from under the article, specially with articles of limited weight.

Another drawback is that the wrapping bar must be moved much quicker because of its longer path, thus the aforementioned swelling effect is increased and a correct and harmonious spreading of the wrapping material piece may be obstructed.

A further disadvantage of such embodiment that prevents a correct spreading of the wrapping material piece around the article 8*a* is due to the long distance of the wrapping bar 5*a* from the surface of the article to be wrapped.

The last drawback, with reference to FIG. 4*a*, results from the fact that the part of the wrapping material piece 7*a* that is behind the wrapping bar 5*a* touches the part of the wrapping material piece 7*a* that is ahead of the wrapping bar 5*a* causing the same undesired effects, already described in the first embodiment.

OBJECT OF THE INVENTION

The main object of the present invention is therefore to avoid the drawbacks reported above.

SUMMARY OF THE INVENTION

The invention, provides a method of claims, resolves the problem of finding out a method and an apparatus for transport of the wrapping material piece during the wrapping phase of articles in a machine for wrapping articles with wrapping material pieces.

The method of the invention is carried out in a wrapping machine comprising:

a wrapping conveyor having an inlet end, outlet end and an upper surface between the two ends for carrying and conveying subsequent articles to be wrapped;

conveying means designed to supply wrapping material for feeding, in single sequence, said wrapping conveyor with wrapping material pieces, placing a leading extremity of said wrapping material piece over the upper surface of said wrapping conveyor in correspondence with said inlet end; and wrapping means carrying wrapping bars along a path surrounding said wrapping conveyor designed to wrap an article, placed on said conveyor, with a single wrapping material piece.

The method transport each piece of wrapping material with a plurality of supporting points set spaced apart from each other in the transport direction and linked to one another.

The invention also proposes an apparatus for setting wrapping material pieces around an article during the article wrapping phase in a wrapping machine for wrapping articles with pieces of wrapping material, with said machine comprising:

a conveyor along which the wrapping takes place, having an inlet end, an outlet end, and an upper surface between the two ends designed to support and convey subsequent articles to be wrapped;

conveying means designed to supply the wrapping material for feeding, in a single sequence, the wrapping conveyor with wrapping material pieces placing the leading extremity of the same over the upper surface of said wrapping conveyor in correspondence with its inlet end; and wrapping means carrying wrapping bars along a path surrounding said wrapping conveyor designed to wrap an article, placed on said conveyor, with a single wrapping material piece.

In the claimed apparatus the wrapping means include:

a plurality of closed loop conveying means;

at least one wrapping element carried by each of the above mentioned conveying means; and driving means designed to drive and correlate the movement of said conveying means.

The following results are obtained by the use of a method and an apparatus of this type:

the rear extremity of the wrapping material piece is withdrawn earlier from the upstream end of the conveyor thus freeing earlier the zone between the feeding conveyor and the wrapping conveyor;

the part of the wrapping material piece behind the wrapping bar does not touch the part ahead the wrapping bar;

the wrapping bar can move close to the surfaces to be wrapped; and the speed of wrapping bar can be a bit higher than the advancement speed of the article to be wrapped.

The first advantage of the present invention is that the articles to be wrapped can be positioned closer one to another, thus reducing the space between the, since the rear of the wrapping material piece is withdrawn earlier from between the feeding and wrapping conveyors, and the machine productive capacity increases.

Another advantage of the present invention is a better spreading of the wrapping material piece around the article in the phase of wrapping of the latter and the possibility to use the above mentioned machine in any environmental conditions and/or with any type of wrapping material and/or any length of wrapping material piece, since damaging effects resulting from a wrapping bar that is far from the surfaces to wrap and/or effects resulting from adherence of the wrapping material pieces one to another are avoided.

DESCRIPTION OF THE PREFERRED EMBODIMENT

Figure 5:
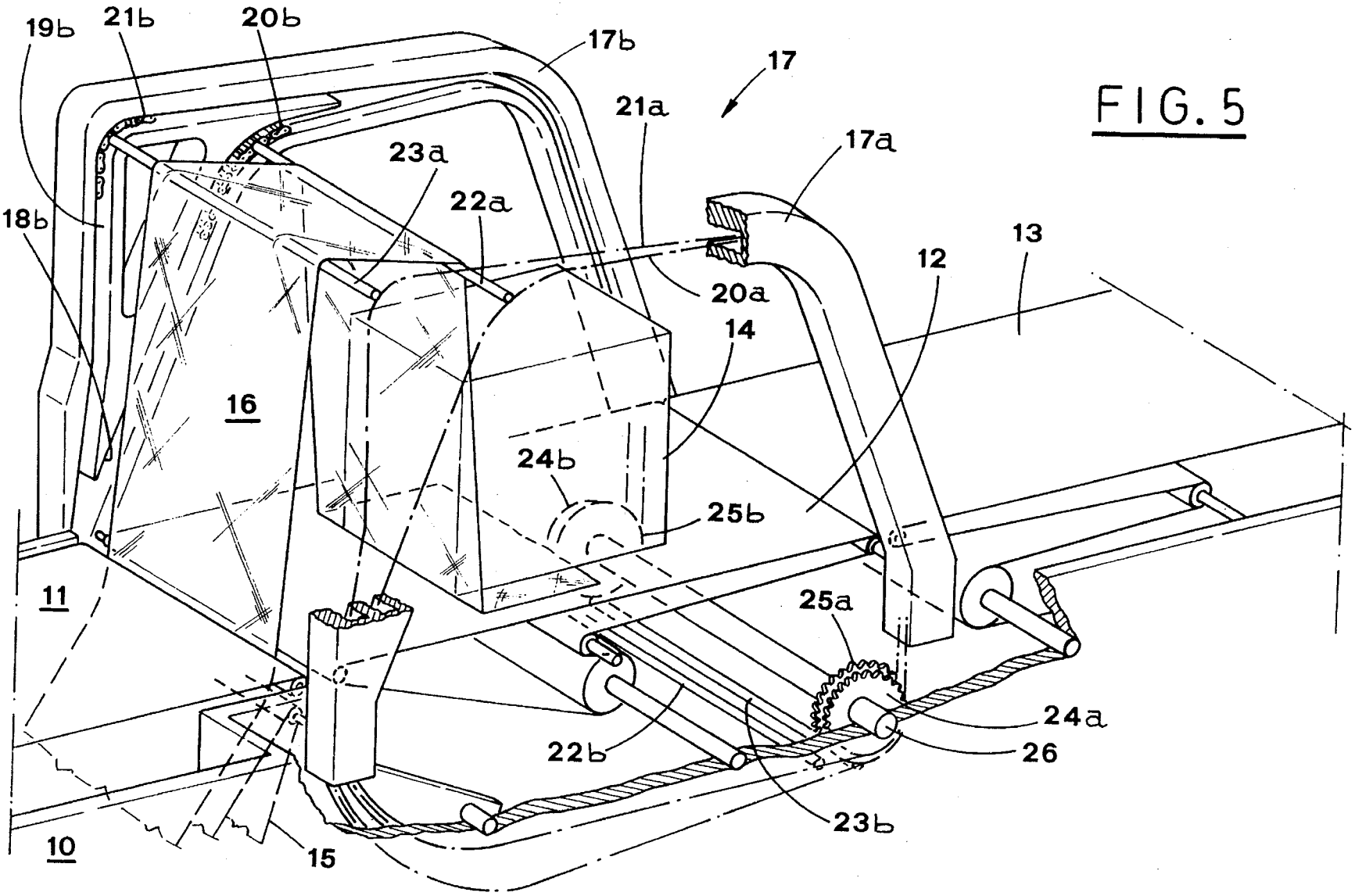
FIG. 5 is a perspective view of a portion of a wrapping machine in accordance with the invention.
Figure 6:
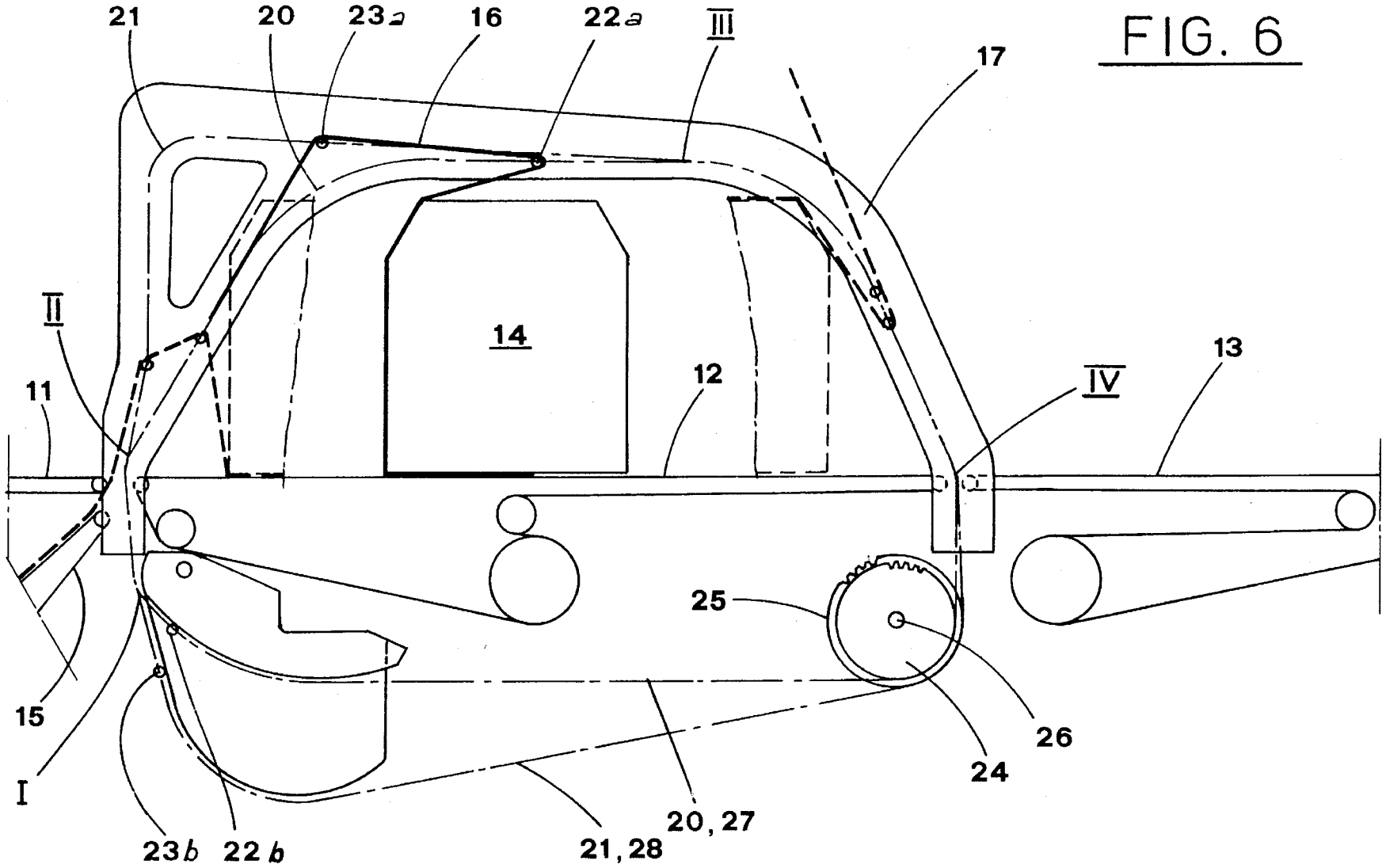
FIG. 6 is a diagrammatic side view of the machine showing one position in solid lines and prior and subsequent positions in broken lines.

With reference to FIGS. 5–13 and, in particular FIGS. 5 and 6, the wrapping machine is constituted by a base 10 that carries a first conveyor 11 designed to support and feed, in single sequence, articles 14 to a second conveyor 12 on which the articles are wrapped; and by a third conveyor 13 that receives the articles from the second conveyor 12 and that complete the wrapping thereof.

Below said machine there is a conveyor 15 designed to feed, in succession, individual wrapping material pieces 16, putting their leading ends over the upstream end of the second conveyor 12.

Astride of the second conveyor 12, and near to it, there is a frame 17 including two uprights 17*a*, 17*b*, arranged in a mirror-like manner on the sides of the conveyor 2 and extending therealong.

Each upright 17*a*, 17*b*, e.g. 17*b* defines a pair of sliding guides 18*b*, 19*b*, guiding respective chains 20*b*, 21*b*, each of which transports one end of respective plurality of wrapping bars 22*a*, 22*b* and 23*a*, 23*b*, only two of them being present in the indicated example.

The other end of the bars 22*a*, 22*b* and 23*a*, 23*b* is supported by the chains 20*a*, 21*a*, guided slidingly in respective guides 18*a*, 19*a*, defined by the upright 17*a*.

Said chains 20*a*–21*a*, 20*b*–21*b* are moved by respective chain supporting wheels 24*a*–25*a* and 24*b*–25*b* that are keyed on a common driving shaft 26.

Thus, the bars 22–23 of each pair of bars 22*a*–23*a*, 22*b*–23*b* are transported together.

Arranged in the way shown in FIG. 6, the bars 22 describe a first orbit 27, contained in a vertical plane circumscribing the conveyor 12; while the bars 23 describe a second longer orbit 28, contained in a vertical plane preferably parallel to the previous one, and circumscribing the conveyor 12.

Still with reference to FIG. 6, said orbits 27 and 28 have a path I-II coincident, a path II-III first divergent and then convergent, a path III-IV coincident, and a path IV-I first divergent and then convergent; this causes the change of the relative distance between the single bars 22, 23 during circulation of each pair of bars 22*a*–23*a*, 22*b*–23*b*.

Such changeable relative distance is obtained by making the orbital path 27 shorter than the orbital path 28, and, simultaneously, the pitch line of the driving wheel 24 shorter than the one of the wheel 25, and making both wheels 24 and 25 rotate with the same angular speed in order to compensate the difference of the path of the chains 20, 21.

With such arrangement, it is possible to change relative distance between the reciprocal bars 22, 23 of each pair of bars 22*a*–23*a*, 22*b*–23*b* by shifting one of them in respect to the other; it is also possible to change the orbital speed of the pair of bars 22*a*–23*a*, 22*b*–23*b* or the speed of a single bar in respect to the other, providing for replacement of one or both driving wheels with others of different pitch line.

The wrapping machine is also equipped with a kinematic mechanism (not shown because it is not part of the subject of the present invention) such that it synchronises the movements of the three conveyors 11, 12, 13, of the carrier 15, and of the shaft 26 so as to obtain a synchronisation for the proceeding articles 14, for the wrapping material pieces 16 being fed and for the pair of wrapping bars 22, 23.

With reference to FIGS. 7 to 13, that illustrate the principal operative phases of the wrapping of an article in sequence, the wrapping machine feeds the articles 14*a*, 14*b* to the conveyor 12 by the conveyor 11 in sequence.

Figure 7:
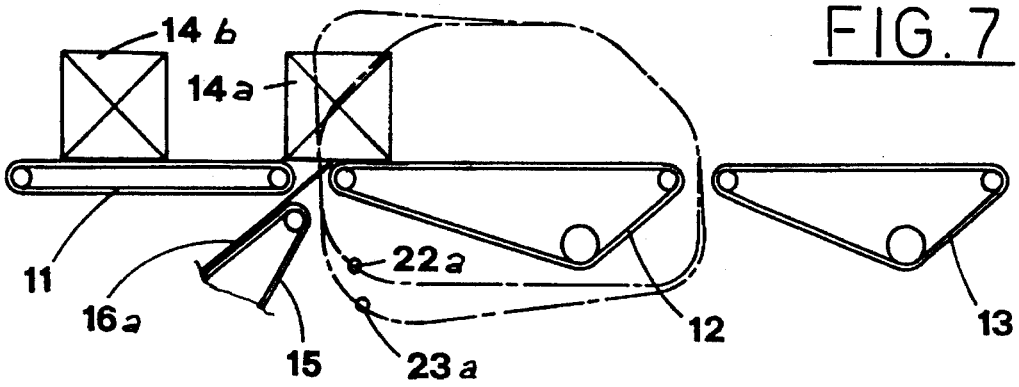
FIGS. 7–13 are sequence diagrams illustrating operation of the wrapping machine of the invention.

As is shown in FIG. 7, an article 14*a* is situated over the two conveyors 11 and 12, and the leading extremity of a wrapping material piece 16*a* is so placed as to be interposed between the bottom of the article 14*a* and the transport surface of the conveyor 12.

Figure 8:
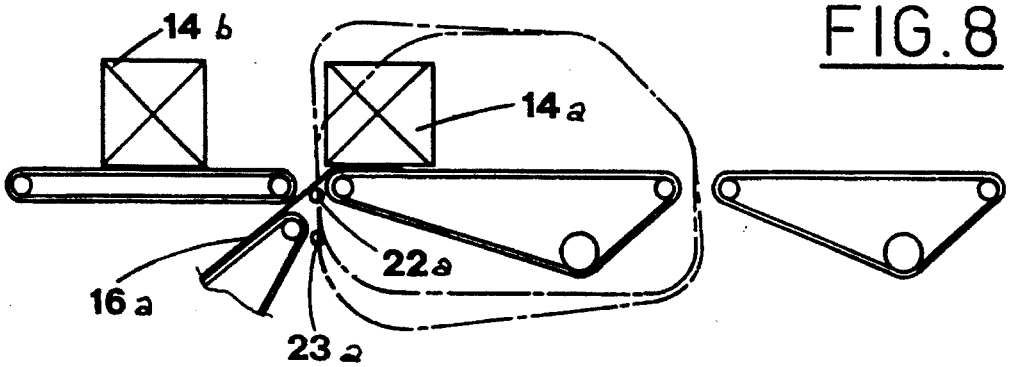

As is shown in FIG. 8, the leading extremity of the wrapping material piece 16*a* is interposed between the bottom of the article 14*a* and the transport surface of the conveyor 12; when the whole article 14*a* is on the conveyor 12, the wrapping bar 22*a* comes into contact with the wrapping material piece being fed, while the bar 23*a* remains slightly behind.

Figure 9:
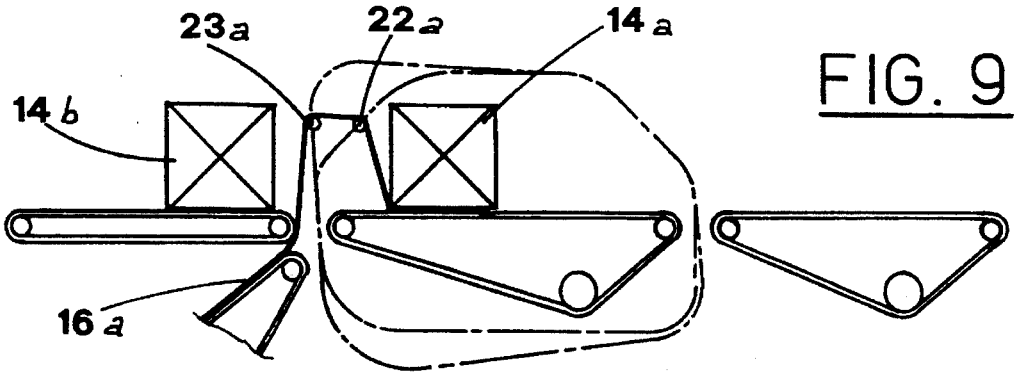

As is shown in FIG. 9, the bar 22*a* spreads the wrapping material 16*a* on the back facing of the article.

The bar 23*a*, also interposed between the two conveyors 11 and 12, has come in contact with and raised the wrapping material piece. A subsequent article 14*b* on the conveyor 11 behind the article 14*a* is moved towards the conveyor 12 by the conveyor 11.

Figure 10:
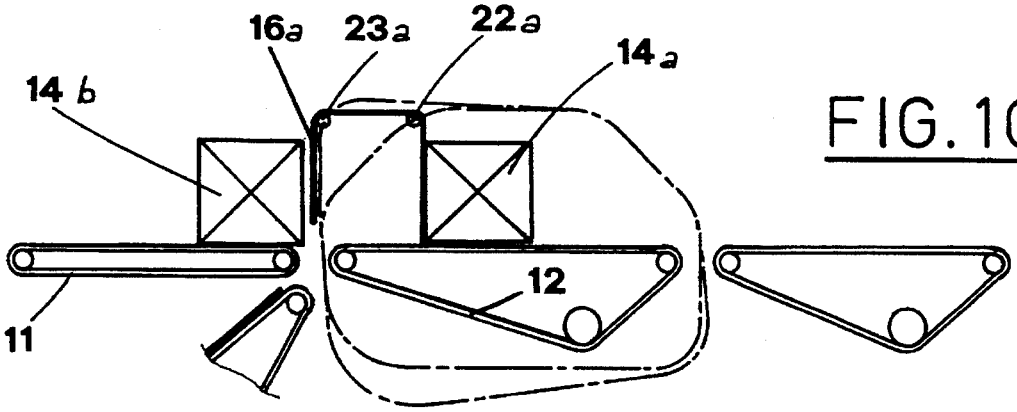

With reference to FIG. 10, the rear extremity of the wrapping material 16*a* is already above the level of the conveyors 11 and 12, thus freeing this zone for the feeding of the subsequent article 14*b*.

Comparing this arrangement with the one illustrated in FIG. 3*a*, relative to the known technique, the new arrangement increases the portion of the wrapping material that is withdrawn, thus allowing for the reduction of the space between the articles to be wrapped; in comparison with FIG. 4, also related to the known technique, the wrapping bar moves close to the surface of the article, improving the spreading of the wrapping material piece thereon.

Figure 11:
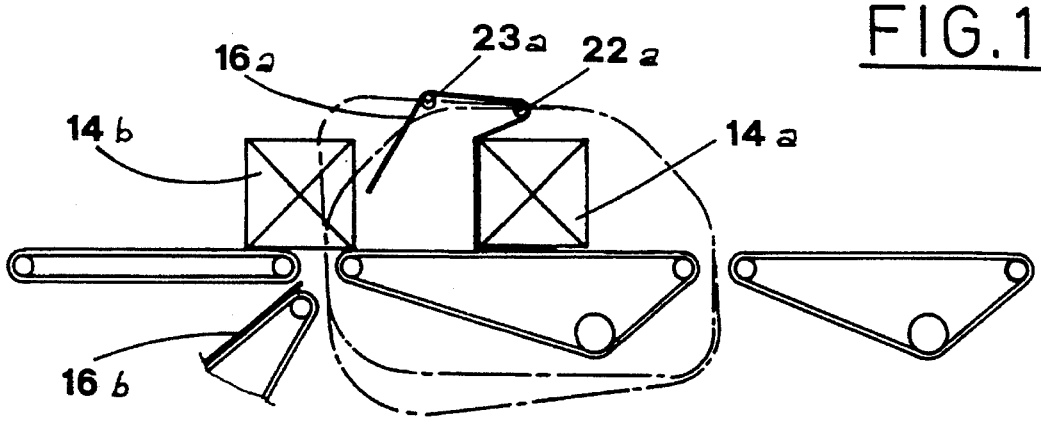

As seen from FIG. 11, the wrapping material piece 16*a* is carried and transported by the bars 22*a*, 23*a* that define its linear segmented configuration.

In comparison with the conformation illustrated in FIG. 3*b*, the segmented conformation of the web in FIG. 11 prevents the contact or overlapping of the parts of the wrapping material piece behind and before the bar 22, thus eliminating the undesired effects reported earlier; comparing the invention with FIGS. 4*a*, also illustrating the known technique, the wrapping bar appears to be closer to the upper surface of the article, also avoiding the disadvantages reported earlier.

Figure 12:
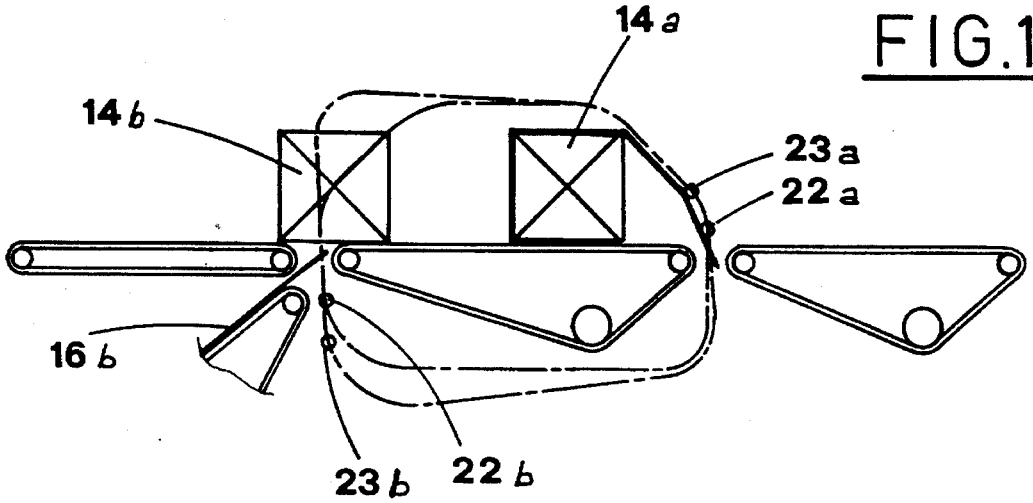

With reference to FIGS. 12, the bar 22*a*, together with the bar 23*a*, has partially wrapped the article 14*a* and has brought the rear extremity of the wrapping material 16*a* to pass between the conveyors 12 and 13, then positioning it below the transport surface of the same.

The subsequent article 14*b* is placed on the conveyors 11 and 12, the leading extremity of a subsequent wrapping material 16*b* is situated below the bottom of the same article and the transport surface of the conveyor 12; a subsequent pair of wrapping bars 22*b*, 23*b*, moving in phase relation with the article 14*b* that is now advancing as well as with the wrapping material piece 16*b* being fed, entrain the new piece of wrapping material; the conditions illustrated in FIG. 7 relative to the article 14*a*, are thus repeated and the operating cycle may take place again.

Figure 13:
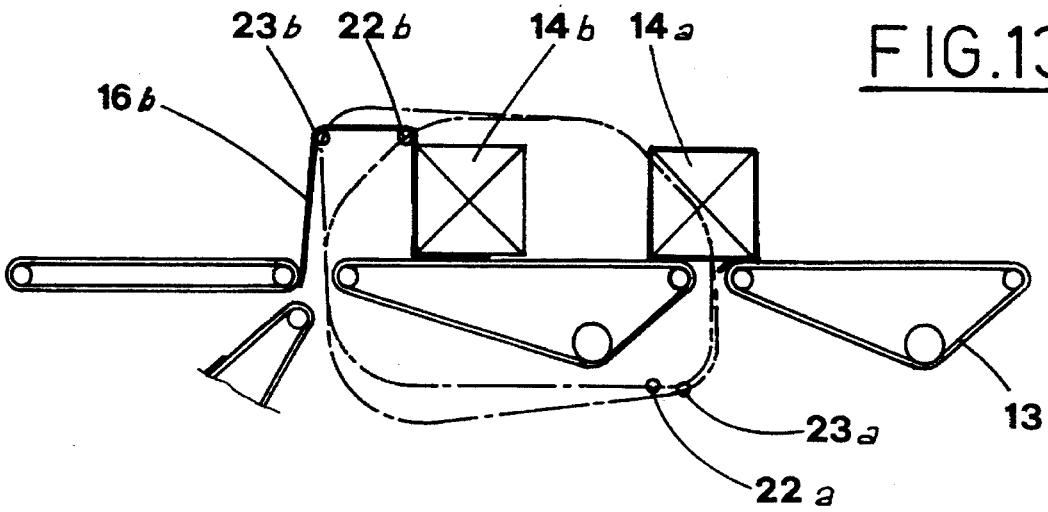

With reference to FIG. 13, the article 14*a* can be seen to be transported from the conveyor 12 to the conveyor 13 and in this passage the rear extremity of the wrapping material piece 16*a* is placed below the leading extremity of the same wrapping material piece 16*a*, thus completing the wrapping of the article 14*a*.

The article 14*b* proceeds and, as for the previous article, the leading extremity of a subsequent wrapping material piece 16*b* has been interposed between the bottom of the article and the transport surface of the conveyor 12.

What is claimed is:

1. A method of wrapping an article comprising the steps of:

(a) feeding a piece of wrapping material to an upstream end of a wrapping conveyor so that a leading end of said piece overlies a receiving surface of said wrapping conveyor;

(b) advancing an article onto said receiving surface and the leading end of said piece of wrapping material thereon from a feeding conveyor upstream of said wrapping conveyor, and displacing said wrapping conveyor to forward said article there-along;

(c) displacing a first supporting member in a first orbit around said wrapping conveyor in engagement with said piece of wrapping material over a stretch reaching from between said conveyors behind said article to a location ahead of said article to raise a free portion of said piece of wrapping material behind said article, along a top of said article and to a location ahead of said article in movement in a phase relationship with displacement of said wrapping conveyor;

(d) simultaneously with step (c) displacing a second supporting member in a second orbit around said wrapping conveyor in engagement with said piece of wrapping material over a stretch behind said first member and spaced rearwardly therefrom along a rear portion of said article and the top of said article and outwardly of said first orbit to said location ahead of said article in movement in a phase relationship with displacement of said wrapping conveyor and with movement of said first member, a spacing between said stretches initially increasing to enable another piece of wrapping material to be fed to said wrapping conveyor and another article to be fed onto said wrapping conveyor, and then decreasing toward said location;

(e) thereafter displacing said free portion of said wrapping material downwardly across a leading portion of the article by displacing both of said members downwardly along coincident stretches of both of said orbits to position a trailing end of said free portion below the leading end of said piece of wrapping material at a discharge end thereof; and (f) displacing the article wrapped by the respective piece of wrapping material off said discharge end and onto a discharge conveyor thereby overlapping the respective trailing and leading ends of the piece of wrapping material around the wrapped article.

2. The method defined in claim 1 wherein said members are displaced along the respective orbits at different speeds.

3. The method defined in claim 1 wherein said members have a spacing which increases upon passage of said members between said orbiting conveyor and said feeding conveyor until said members are located above said article and then decreases to said location.

4. An apparatus for wrapping an article comprising:

an orbiting conveyor having an upstream end and a discharge end;

means for feeding pieces of orbiting material in succession to said upstream end of said orbiting conveyor so that a leading end of each of said pieces overlies a receiving surface of said orbiting conveyor;

a feeding conveyor upstream of said orbiting conveyor for advancing an article to be wrapped onto said receiving surface and the leading end of a respective piece of orbiting material thereon, whereby displacement of said orbiting conveyor forwards said article therealong with said article overlying the respective piece of orbiting material and a free portion of the respective piece of orbiting material trailing behind said article;

a first supporting member engageable with said free portion and provided with guide means for displacing said first supporting member in a first orbit around said orbiting conveyor over a stretch reaching from between said conveyors behind said article to a location ahead of said article to raise said free portion of said piece of wrapping material behind said article, along a top of said article and to a location ahead of said article in movement in a phase relationship with displacement of said orbiting conveyor;

a second supporting member engageable with said free portion and guide means for displacing said second supporting member in a second orbit around said orbiting conveyor over a stretch behind said first member and spaced rearwardly therefrom along a rear portion of said article and the top of said article and downwardly of said first orbit to said location in movement in a phase relationship with displacement of said orbiting conveyor and with movement of said first member, said guide means being constructed and arranged to provide a spacing between said stretches initially increasing and then decreasing toward said location, said orbits enabling said members to displace said free portion across a front of the article downwardly along coincident stretches of both said orbits to position a trailing end of said free portion below the leading end of the respective piece of orbiting material at said discharge end; and a discharge conveyor downstream of said orbiting conveyor receiving said article from said wrapping conveyor, thereby overlapping the respective trailing and leading ends of said piece of wrapping material.

5. The apparatus defined in claim 4 wherein said guide means are respective chains entraining said members around respective closed paths forming said orbits.

6. The apparatus defined in claim 5 wherein said guides are formed on a pair of uprights straddling said orbiting conveyor.

7. The apparatus defined in claim 6, further comprising a double pair of teethed wheels keyed to a common shaft and engaging said chains.

* * * * *